US008593236B2

(12) United States Patent
Hueso Gonzalez et al.

(10) Patent No.: US 8,593,236 B2
(45) Date of Patent: Nov. 26, 2013

(54) MICROWAVE WAVEGUIDE FILTER WITH NON-PARALLEL WALLS

(75) Inventors: Jaime Hueso Gonzalez, Valencia (ES); David Raboso Garcia-Baquero, Leiden (NL); Dietmar Schmitt, Wassenaar (NL)

(73) Assignee: Agence Spatiale Europeenne, Paris Cedex (FR)

( * ) Notice: Subject to any disclaimer, the term of this patent is extended or adjusted under 35 U.S.C. 154(b) by 753 days.

(21) Appl. No.: 11/991,798

(22) PCT Filed: Sep. 12, 2006

(86) PCT No.: PCT/FR2006/002087

§ 371 (c)(1),
(2), (4) Date: Dec. 30, 2009

(87) PCT Pub. No.: WO2007/031639

PCT Pub. Date: Mar. 22, 2007

(65) Prior Publication Data

US 2010/0141357 A1 Jun. 10, 2010

(30) Foreign Application Priority Data

Sep. 12, 2005 (FR) ..... 0509264

(51) Int. Cl.
*H01P 1/208* (2006.01)
*H01P 7/06* (2006.01)

(52) U.S. Cl.
USPC ..... 333/212; 333/230

(58) Field of Classification Search
USPC ..... 333/208–212, 227–233
See application file for complete search history.

(56) References Cited

U.S. PATENT DOCUMENTS

| | | | | |
|---|---|---|---|---|
| 5,231,073 | A | 7/1993 | Cohn et al. | |
| 5,534,881 | A * | 7/1996 | Young et al. | 343/776 |
| 5,821,836 | A * | 10/1998 | Katehi et al. | 333/202 |
| 6,960,747 | B2 * | 11/2005 | Risman | 219/690 |
| 2005/0184835 | A1 | 8/2005 | Mack | |

FOREIGN PATENT DOCUMENTS

| | | |
|---|---|---|
| EP | 0 700 111 | 3/1996 |
| GB | 2 388 703 | 11/2003 |
| JP | 2004-048486 | 2/2004 |

OTHER PUBLICATIONS

Ludovico, M. et al. "Multipaction Analysis and Power Handling Evaluation in Waveguide Components for Satellite Antenna Applications", *exp*, vol. 1, No. 1, Dec. 2001, pp. 20-23.

Dunbar, W.G. et al. "High Frequency Breakdown Characteristics of Various Electrode Geometries in Air", *Conference Record of the 1998 23rd Int'l. Power Modulator Symposium*, Jun. 22-25, 1998, pp. 221-224.

(Continued)

*Primary Examiner* — Benny Lee
*Assistant Examiner* — Gerald Stevens
(74) *Attorney, Agent, or Firm* — Clark & Brody

(57) ABSTRACT

The invention concerns a waveguide filter (200$^{NP}$) for microwaves, characterized in that it has, at least on part of its length, a cross-section having two mutually non-parallel opposite sides (111, 111'), for example trapezoid. The use of such a shape enables the power threshold for forming self-maintained electron avalanche discharges to substantially increased and satisfactory filtering properties to be obtained. The invention also concerns the use of such a filter in a high-power microwave transmitter operating in X and Ka bands, in particular for space applications.

13 Claims, 3 Drawing Sheets

(56) References Cited

OTHER PUBLICATIONS

Kishek, R.A. et al. "Multipactor Discharge on a Dielectric", *Proceedings of the 1997 Particle Accelerator Conference*, vol. 3, May 12-16, 1997, pp. 3198-3200.

Geng, R.L. et al., "Exploring Multipacting Characteristics of a Rectangular Waveguide", *PAC*[13], 1999, p. 429.

Geng, R. et al., "Multipacting in a rectangular waveguide", *Proceedings of the Particle Accelerator Conference*, Chicago 2001, pp. 1228-1230.

Saito, Y., "Surface Breakdown Phenomena in Alumina rf Windows", *IEEE Transactions on Dielectrics and Electrical Insulation*, vol. 2, No. 2, Apr. 1995, pp. 243-250.

Primdahl, K. et al., "Reduction of Multipactor in RF Ceramic Windows Using a Simple Titanium-Vapor Deposition System", *Proceedings of the 1995 Particle Accelerator Conference*, 1995 pp. 1687-1689.

Chojnacki, E., "Simulations of a multipactor-inhibited waveguide geometry", *Physical Review Special Topics—Accelerators and Beams*, vol. 3 (032001), 2000, pp. 032001-1-032001-5.

Kochbach, J. et al., "Design Procedure for Waveguide Filters with Cross-Couplings", *International Microwave Symposium Digest, IEEE MTT-S*, vol. 3, Jun. 2-7, 2002, pp. 1449-1452.

Vanin, F., et al., "Dimensional Synthesis for Wideband Waveguide Filters", *International Microwave Symposium Digest, IEEE MTT-S*, vol. 2, Jun. 6-11, 2004, pp. 463-466.

Young, L., "Stepped-Impedance Transformers and Filter Prototypes" (1962) *IEEE Transactions on Microwave Theory and Techniques*, vol. 10, No. 5, Sep. 1962, pp. 339-359.

* cited by examiner

MICROWAVE WAVEGUIDE FILTER WITH NON-PARALLEL WALLS

The invention relates to a microwave waveguide filter presenting geometry that is modified so as to make it better at withstanding self-sustained electron-avalanche discharges, and it also relates to a microwave transmitter, in particular for space applications, that is fitted with such a filter.

BACKGROUND OF THE INVENTION

The term "microwave" is used herein to mean electromagnetic radiation at a frequency lying in the range 1 gigahertz (GHz) to 100 GHz, approximately.

Self-sustained electron-avalanche discharging (known as "multipactor", "multipaction" or "multipacting") constitutes an undesirable phenomenon that can occur in microwave waveguide devices operating in a vacuum under high power conditions (typically above 1 kilowatt (kW)). Such discharging is caused by free electrons that, on being accelerated by the electric field oscillating at microwave frequency, strike the walls of the waveguide and therefore cause secondary electrons to be emitted. When the oscillation frequency of the electrons resonates with the frequency of the electric field, the number of electrons grows exponentially, thereby inducing harmful effects such as losses and a high level of noise, and possibly even damage to the waveguide. A more thorough discussion of this phenomenon can be found in the article by M. Ludovico, G. Zarba, L. Accatino, and D. Raboso "Multipaction analysis and power handling evaluation in waveguide components for satellite antenna applications", Exp., Vol. 1, No. 2, December 2001.

The microwave waveguide filters used in satellites, in particular in the outlet sections of multichannel transmitters, but also in the inlet sections of receivers, in diplexers, in orthomode junctions, in antenna power feed systems, etc., are strongly affected by self-sustained electron-avalanche discharges. It is therefore highly desirable to prevent such discharges in the space and telecommunications industry, particularly since there is a trend towards increasing the power levels of the signals that are to be transmitted through a given waveguide device.

Several solutions have been proposed to this problem, but none of them gives full satisfaction.

A first solution, known from the article "High frequency breakdown characteristics of various electrode geometries in air" by W. G. Dunbar, D. L. Schweickart, J. C. Hotwath, and L. C. Walk, Conference Record of the 1998 Twenty-Third International Power Modulator Symposium, 1998, Jun. 22-25, 1998, pp. 221-224, consists merely in using waveguides presenting a relatively large minimum spacing between the E planes: that ensures that the maximum electric field in the waveguide is kept below a discharge threshold value. Unfortunately, that solution degrades the filtering properties of devices; in addition it leads to increasing their weight and their size, both of which are very troublesome in the context of space applications.

Another solution consists in maintaining within the waveguide a gas at a pressure that is sufficiently high, so as to reduce the mean free path length of electrons, thereby increasing the threshold power at which self-sustained electron-avalanche discharges appear. That solution also presents drawbacks, since the presence of the gas can lead to corona discharges and constitutes a potential source of passive intermodulation (PIM). In addition, pressurization equipment increases the weight, the size, and the cost of the system significantly.

To shorten the mean free path length of electrons, it is also possible to fill the waveguide with a solid dielectric or a dielectric in the form of a foam, but that increases the level of losses. In this context, reference can be made to the article by R. A. Kishek and Y. Y. Lau "Multipactor discharge on a dielectric", Proceedings of the 1997 Particle Accelerator Conference", Vol. 3, May 12-16, 1997, pp. 3198-3200, Vol. 3.

R. L. Geng and H. Padamsee (PAC[13], 1999, p. 429) have proposed using electric and/or magnetic fields that are constant in order to disturb the paths followed by electrons and prevent them from entering into resonance with the microwave frequency field. Unfortunately, that solution requires special equipment to generate the constant fields, thereby increasing the weight, the size, and the cost of the system.

The same authors have also proposed opening slots in the walls of the waveguide ("Multipacting in a rectangular waveguide", R. Geng, H. Padamsee, V. Shernelin, Proceedings of the Particle Accelerator Conference, Chicago 2001). A drawback of that solution is the risk of losing radiation through said slots.

Another solution known in the prior art, e.g. proposed by Y. Saito ("Surface breakdown phenomenon in aluminum RF windows", IEEE Transactions on Dielectrics and Electrical Insulation, Vol. 2, No. 2, April 1995) and by K. Primdahl et al. ("Reduction of multipactor in RF ceramic windows using a simple titanium-vapor deposition system", K. Primdahl, R. Kustom, J. Maj, Proceedings of the 1995 Particle Accelerator Conference, 1995) consists in using suitable coatings and/or surface treatments, which are nevertheless liable to introduce high loss levels.

Consequently, there exists a need to increase the power that can be injected into a microwave filter without running the risk of inducing a self-sustained electron-avalanche discharge, while avoiding degrading its electrical properties, such as loss levels in the passband, bandwidth, cut-off band attenuation, and/or noise and intermodulation levels, or at least while ensuring that these degradations are kept to an acceptable level, and to do so without excessively increasing the cost, the weight, and/or the size of the filter.

The invention provides a solution to at least one of the above-mentioned problems.

The principle on which the invention is based is using a waveguide presenting two opposite walls that are not mutually parallel, while presenting a cross-section that is constant at least locally, i.e. constant over a certain length, thereby enabling the paths followed by secondary electrons to be modified in such a manner as to increase greatly the threshold at which self-sustained electron-avalanche discharges appear. This effect was observed for the first time by E. Chojnacki (Physical review special topics—accelerators and beams, Vol. 3, 032001-2000) for waveguides of constant section operating at radiofrequency (RF) (500 megahertz (MHz)) under steady or quasi-steady conditions.

In general, it is expected that a modification to the geometry of a waveguide will greatly disturb the electrical properties of a device constructed using said waveguide, and in particular its frequency response: on this topic reference can be made to the above-discussed effect of increasing the minimum spacing. That does not give rise to particular problems in the application considered by Chojnacki, i.e. transmission under steady or quasi-steady conditions, substantially at a single frequency, but it can be completely unacceptable for a filter.

Nevertheless, the inventors have discovered that by replacing waveguide segments of rectangular section in a conventional microwave filter with waveguide segments of cross-sections that present two opposite sides that are not mutually parallel, and by appropriately modifying certain dimensions of the various elements of said filter, it is possible to obtain a transfer function that is substantially identical to that of the initial filter, at least within a working band. It is thus possible to increase the ability of the filter to withstand self-sustained electron-avalanche discharges while nevertheless conserving its filter properties. In addition, the solution of the invention makes it possible to keep the size and the weight of the filter substantially constant. Even if the cost of fabrication it is likely to be slightly greater than for a conventional filter, the extra cost remains less than that associated with most solutions known in the prior art.

The inventors have also developed a design method for determining the dimensional modifications that need to be made to an initial conventional filter in order to maintain its filter properties in spite of rectangular waveguide segments being replaced by waveguide segments having walls that are not parallel.

OBJECTS AND SUMMARY OF THE INVENTION

In one aspect, the invention thus provides a microwave waveguide filter comprising a plurality of side walls and having, over at least a fraction of its length, a cross-section comprising a plurality of sides formed by sections of said side walls and a single hollow internal region of outline defined by said sides, wherein two opposite ones of said sides are not mutually parallel.

In particular embodiments of the invention:

- said opposite sides that are not mutually parallel are the long sides;
- said hollow internal region presents a cross-section in the form of a triangle, a trapezoid, or a circular sector, or a circular annulus;
- said two non-parallel opposite sides are interconnected by two opposite sides that are mutually parallel;
- said cross-section presents an axis of symmetry;
- said cross-section is constant, at least locally;
- said two non-parallel opposite sides form between them an angle lying in the range 5° to 35°, preferably in the range 15° to 35°, and still more preferably in the range 20° to 30°;
- said fraction of its length in which the cross-section presents two opposite sides that are not mutually parallel comprises at least the segment(s) within which the maximum intensity of the electrical field is the greatest;
- the filter may be of the type having irises and resonant cavities;
- the filter may present at least one cut-off frequency in one of the following bands: X, Ku, K, and Ka. Using the British convention, as adopted herein, band X extends from 8 GHz to 12 GHz, band Ku from 12 GHz to 18 GHz, band K from 18 GHz to 26 GHz, and band Ka from 26 GHz to 40 GHz.

In another aspect, the invention provides a microwave transmitter including such a filter, in particular a filter presenting peak power of at least 0.5 kW in the X to Ka bands. Typical values for the thresholds at which self-sustained electron-avalanche discharges are formed in the bands under consideration are about 500 watts (W) to 2 kW for bandpass filters and 4 kW or more for lowpass filters.

BRIEF DESCRIPTION OF THE DRAWINGS

Other characteristics, details, and advantages of the invention appear on reading the following description made with reference to the accompanying drawings given by way of example and showing, respectively.

MORE DETAILED DESCRIPTION

Figure 1:
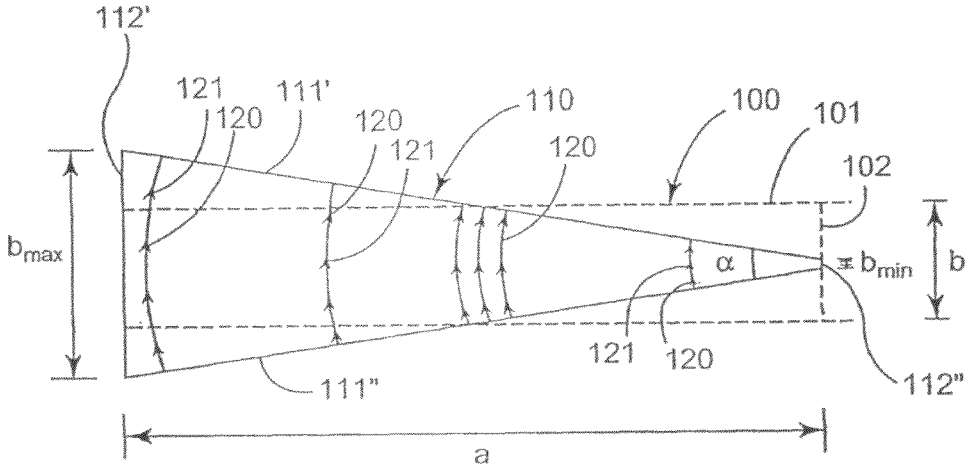
FIG. 1, a cross-section of a filter in an embodiment of the invention.

FIG. 1 is a cross-section of a segment of a waveguide having non-parallel walls and designed, in accordance with the invention, to replace a segment of rectangular waveguide within a microwave filter. The cross-section of the reference rectangular waveguide, shown in dashed lines and identified by reference sign 100, presents a first side 101 of length a=22.86 millimeters (mm) ("width" of the waveguide) and a second side 102 of length b=4 mm ("height" of the waveguide). In conventional manner, the electric field of waves propagating in the waveguide is perpendicular to the long side 101. In the waveguide 110 having non-parallel walls, the sides 101 of the cross-section of the rectangular waveguide 100 are replaced by two sides 111' and 111" that form between an angle $\alpha$=19°, and the sides 102 are replaced by sides 112' and 112" that are mutually parallel, but of a different length. In particular, the side 112' presents a length $b_{max}$=7.8 mm and the side 112" presents a length $b_{min}$=0.2 mm: in this way, the mean height of the waveguide 110, i.e. $(b_{max}+b_{min})/2$, is equal to the height of the reference rectangular waveguide 100, i.e. 4 mm.

Reference sign 120 designates the vectors representing the electric field inside the waveguide 110. It can be seen that the field is most intense in the central region of said waveguide and that its force lines 121 are approximately circular in shape. Similarly, in the frequency domain under consideration here (X to Ka bands, i.e. about 8 GHz to about 40 GHz), this electric field distribution effectively eliminates self-sustaining discharges by deflecting the paths of electrons, as observed by Chojnacki at much lower frequencies (500 MHz).

It should be understood that the dimensions given above are given purely by way of example and that they can be modified in order to adapt them to different applications of the invention. In particular, the angle $\alpha$ formed by the non-parallel sides 111' and 111" need not necessarily have a value of 19°: as a general rule, the greater the value of the angle $\alpha$, the more effective the suppression of self-sustained discharges, but the greater the departure of the electrical characteristics of the modified filter from those of the reference filter of rectangular section. Typically, acceptable values for the angle $\alpha$ lie in the range 5° to 35°, preferably in the range 15° to 35°, and still more preferably in the range 20° to 30°, with an angle of about 30° being particularly preferred.

In the example of FIG. 1, the shape of the cross-section of the waveguide 110 is trapezoidal or even nearly triangular. It should be understood that this does not constitute a limitation either: a cross-section of the invention may for example be in the form of a trapezoid, a triangle, or a circular sector, or a circular annulus or ring. Although an annulus is much more difficult to fabricate, it is much easier to analyze, since the propagation modes can be expressed in an analytic form. The invention also covers the situation where one of the non-parallel sides of said cross-section, or both of them, is/are not rectilinear but presents a shape that is curved or undulating.

In the embodiment of FIG. 1, the sides 112' and 112" are mutually parallel, and the waveguide 110 presents a plane of symmetry 130. Although preferred, these characteristics are not essential.

It is also possible to design a waveguide in which the short sides are not mutually parallel, while the long sides are. However, under such circumstances, in order to preserve the effect of eliminating self-sustaining discharges, it is necessary for the electric field of waves propagating in the waveguide to be perpendicular to the long side, which is unusual.

Figure 2A:
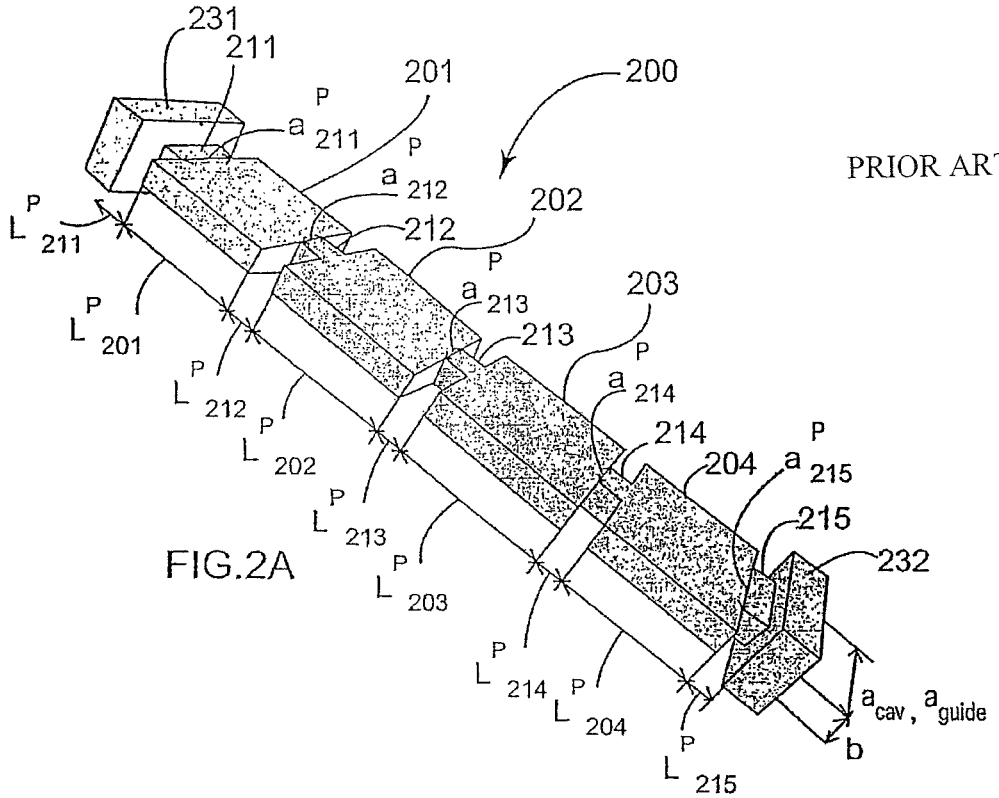
FIGS. 2A and 2B, respectively, elevation views of a conventional filter and of a corresponding filter constituting an embodiment of the invention.

The principle of the waveguide with non-parallel walls is applied below by way of non-limiting example to making a 4th order bandpass filter of the symmetrical type having resonant cavities and irises. The specifications require attenuation of at least 25 decibels (dB) over a band having a width of 100 MHz about a center frequency $f_c$=9.5 GHz (9.45 GHz–9.55 GHz). The reference filter constituted by waveguide elements of rectangular section is shown in FIG. 2A. Such a filter 200 is constituted by four cavities in the form of rectangular parallelepipeds 201, 202, 203, and 204, all having the same width $a_{cav}$=22.86 mm and the same height b=4 mm, but having different lengths $L^P_{201}$, $L^P_{202}$, $L^P_{203}$, and $L^P_{204}$. The cavities are connected to one another and to inlet and outlet waveguides 231 and 232 by five narrower sections referred to as "irises", 211 (between the inlet waveguide 231 and the first cavity 201), 212 (between the cavities 201 and 202), 213 (between the cavities 202 and 203), 214 (between the cavities 20 and 204), and 213 (between the cavity 204 and the outlet waveguide 232). All of the irises present the same height b=4 mm, but they present different widths $a^P_{211}$, $a^P_{212}$, $a^P_{213}$, $a^P_{214}$, and $a^P_{215}$, and different lengths $L^P_{211}$, $L^P_{212}$, $L^P_{213}$, $L^P_{214}$, and $L^P_{215}$. The filter is symmetrical in the sense that its two "external" cavities 201 and 204 are equal to each other, as are its two "internal" cavities 202 and 203, its two "external" irises 211 and 215, and its two "medium" irises 212 and 214: a plane of symmetry of the filter thus passes through the center iris 213. The dimensions of the cavities and of the irises are as follows:

$L^P_{201}=L^P_{204}$=17.825 mm $L^P_{202}=L^P_{203}$=20.47 mm $L^P_{211}=L^P_{212}=L^P_{213}=L^P_{214}=L^P_{215}$=3 mm $a^P_{cav}$=22.86 mm for the four cavities 201, 202, 203, and 204

$a^P_{211}=a^P_{215}$=11.83 mm $a^P_{212}=a^P_{214}$=6.78 mm $a^P_{213}$=6.22 mm b=4 mm for all of the elements.

The superscript P applies to the dimensions for the reference filter, of rectangular cross-section, i.e. having sides that are parallel.

The inlet and outlet waveguides 221 and 222 are standard waveguide segments of rectangular section, of the WR90 type ($a_{guide}$=22.86 mm, $b_{guide}$=10.16 mm), and have a length of 10 mm.

It can be seen that both the cavities 201-204 and the irises 211-215 are in fact constituted by segments of rectangular section waveguide all presenting the same height b and differing widths a and length L.

Figure 3:
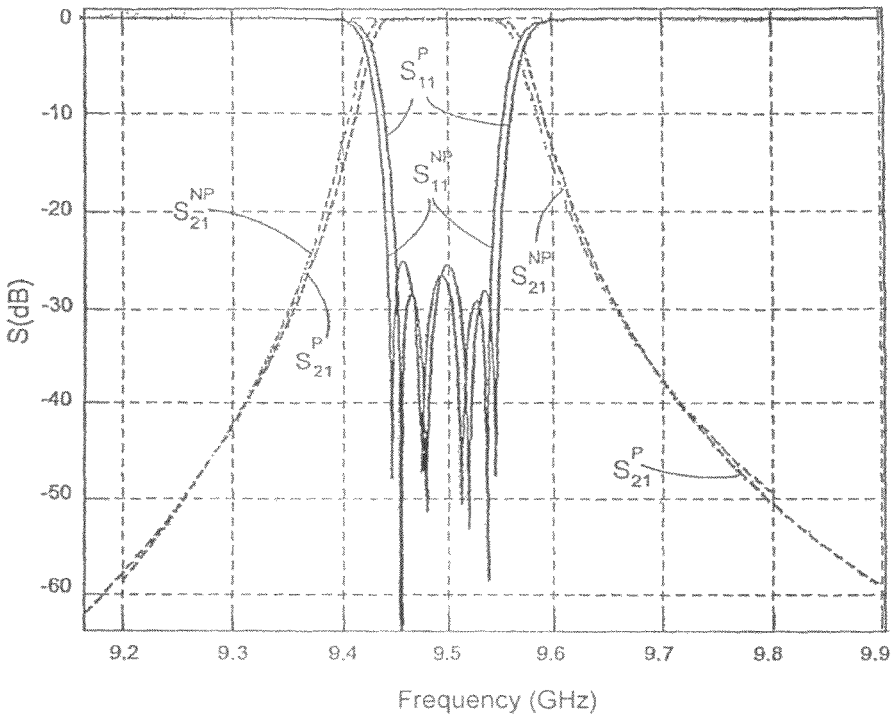
FIG. 3, a graph showing the frequency dependency of the S parameters of the filters of FIGS. 2A and 2B.

The frequency dependency of the parameters $S_{11}$ (transmission from the inlet waveguide 231 to the outlet waveguide 232) and $S_{12}$ (reflection of waves injected into the filter from the inlet waveguide 231) of the filter 200 is shown in FIG. 3 (cures $S^P_{11}$ and $S^P_{21}$).

To modify the filter 200, of a type that is known in the prior art, so as to obtain a filter of the invention, the first step is to replace each rectangular section waveguide segment by a waveguide segment having walls that are not parallel, but having the same mean height: $(b_{max}+b_{min})/2=b$. More precisely, the same geometry is selected as shown in FIG. 1, i.e. a section in the form of an isosceles trapezoid. The value of the angle $\alpha$ is selected, in arbitrary manner, to be equal to 19°. In a real design, the value taken for $\alpha$ should be the smallest possible value that makes it possible to eliminate self-sustained electron-avalanche discharges. Determining the optimum value for $\alpha$ for a determined application may be performed by successive tests, for example.

Modifying the cross-sections of the various filter elements does not leave the electrical characteristics of the device unchanged. Nevertheless, the inventors have found that a systematic method of adjusting certain dimensions makes it possible in a manner that is simple and relatively fast, to return to a transfer function that is very similar to the original transfer function.

Figure 2B:
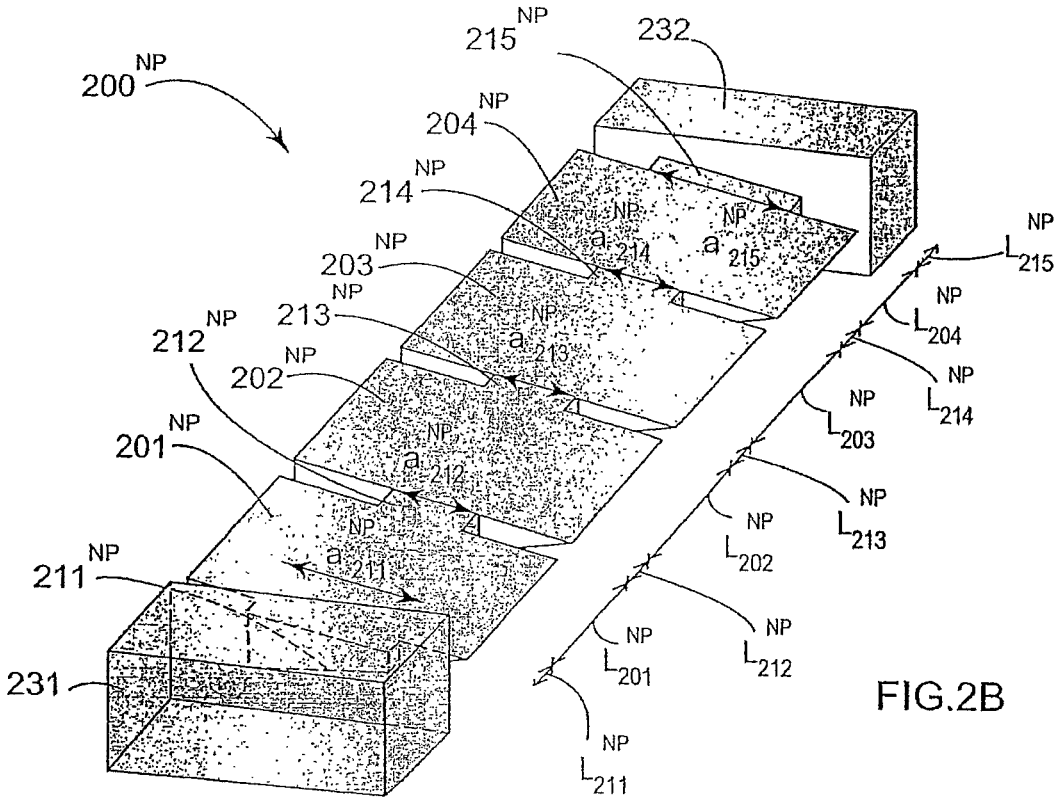

The filter $\mathbf{200}^{NP}$ of the invention that is obtained by applying this method is shown in FIG. 2B. The various elements of the filter and the corresponding dimensions are identified by the same reference signs as for the conventional type filter 200 of FIG. 2A, but with a superscript NP for sides that are "not parallel".

The first step of the dimension-adjustment method consists in modifying the widths of the modified irises $a^{NP}_{211}$, $a^{NP}_{212}$, $a^{NP}_{213}$, $a^{NP}_{214}$, and $a^{NP}_{215}$ so that the modulus of the parameter $S_{21}$ at the band center for each modified iris is the same as that for the corresponding rectangular section iris. This can be done using numerical simulation, e.g. performed by using the FEST3D simulator, developed by ESTEC or HFSS, distributed by Ansoft Corp.

Thereafter, the modified irises $\mathbf{211}^{NP}$, $\mathbf{212}^{NP}$, $\mathbf{213}^{NP}$, $\mathbf{214}^{NP}$, and $\mathbf{215}^{NP}$ are analyzed, still with the help of numerical simulation, in order to calculate the phases of their parameters $S_{11}$ and $S_{22}$. Finally, these values are used for determining the length of the cavities $\mathbf{201}^{NP}$-$\mathbf{204}^{NP}$ so as to return to the desired frequency response.

In conventional manner, the length of each cavity is determined in two stages: initially, the length of all of the cavities is set as being equal to $\lambda_G/2$, where $\lambda_G$ is the wavelength at the band center in the waveguide, after which the lengths are "adjusted" so as to take account of edge effects (deformation of the field force lines) at the discontinuities between the cavities and the irises. This adjustment step is known for various types of waveguide filter, and is described in the following publications: J. Kocback and K. Folgero "Design procedure for waveguide filters with cross-couplings", 2002 International Microwave Symposium Digest, IEEE MTT-S, Vol. 3, Jun. 2-7, 2002, pp. 1449-1452; F. M. Vanin, D. Schmitt, and R. Levy "Dimensional synthesis for wideband waveguide filters", 2004 International Microwave Symposium Digest, IEEE MTT-S, Vol. 2, Jun. 6-11, 2004, pp. 483-466; and L. Young "Stepped-impedance transformers and filter prototypes", IEEE Transactions on Microwave Theory and Techniques, Vol. 10, No. 5, September 1962, pp. 339-359.

In general, $\lambda_G$ is given by:

$$\lambda_G = \frac{\lambda_0}{\sqrt{1-\left(\frac{\lambda_0}{\lambda_{co}}\right)^2}}$$

where $\lambda_0$ is the wavelength at the band center in the filter and $\lambda_{co}$ is the cut-off wavelength of the waveguide, obtained by numerical simulation for the waveguide having walls that are not parallel. For the fundamental mode $TE_{10}$ of a rectangular waveguide, $\lambda_{co}$ can be expressed in analytic form, and the above expression simplifies to:

$$\lambda_G = \frac{c}{f}\frac{1}{\sqrt{1-\left(\frac{c}{2af}\right)^2}}$$

where c is the speed of light and f is the band center frequency. It can be seen that $\lambda_G$ is not exactly the same for the reference filter of rectangular section and for the filter having walls that not parallel.

The cut-off frequency of the fundamental mode of the filter tends to increase with increasing angle α (see FIG. 5), thereby leading to an increase in $\lambda_g$ and thus to an increases in the length of the filter. In order to return to the same cut-off frequency as the reference rectangular frequency, and thus to the same length, it is nevertheless sufficient to increase the width $a_{cav}$ of the cavities a little.

In addition, modifying the mean height b of the structure does not modify its frequency response, but does make it possible to adjust its Q factor so as to make it coincide with that of the reference rectangular filter.

The dimensions of the cavities and the irises of the filter modified in accordance with the invention are given in millimeters in the following table:

| | a | $b_{max}$ | $b_{min}$ | L |
|---|---|---|---|---|
| Irises 211 and 215 | 13.038 | 6.167 | 1.833 | 3 |
| Cavities 201 and 204 | 22.86 | 7.8 | 0.2 | 21.97 |
| Irises 212 and 214 | 8.086 | 5.344 | 2.656 | 3 |
| Cavities 202 and 204 | 22.86 | 7.8 | 0.2 | 25.455 |
| Iris 213 | 7.423 | 5.234 | 2.766 | 3 |

The tolerances on these dimensions need to be rather narrow (less than 10 micrometers (μm) in this example; with the exact value depending on the specific application under consideration), however they generally remain compatible with fabrication by milling. Nevertheless, fabrication by electroforming is preferred, even though more expensive, because it obtains tolerances that are narrower, thereby simplifying the step of designing the filter.

FIG. 3 shows the frequency dependency of the diffusion parameters of the reference filter 200 (curves $S^P_{11}$ and $S^P_{21}$) and of the modified filter $\mathbf{200}^{NP}$ (cures $S^{NP}_{11}$ and $S^{NP}_{21}$). It can be seen that the filter properties of the two devices are very similar, except for a small shift in the center frequency of the passband, of the order of 7 MHz. To eliminate this shift, it is possible to restart the method of adjusting dimensions starting from a reference filter that is modified slightly, and proceeding by successive steps. In addition, the attenuation of the modified filter $\mathbf{200}^{NP}$ is a little lower at high frequencies: this is due to the fact that the filter with non-parallel walls presents higher order modes at lower frequencies than does the reference filter of rectangular section. An extended analysis at higher frequencies shows that the modified filter $\mathbf{200}^{NP}$ presents the first parasitic passband due to higher order modes at about 13.2 GHz, whereas this band is situated at around 15 GHz for the reference filter.

Figure 5:
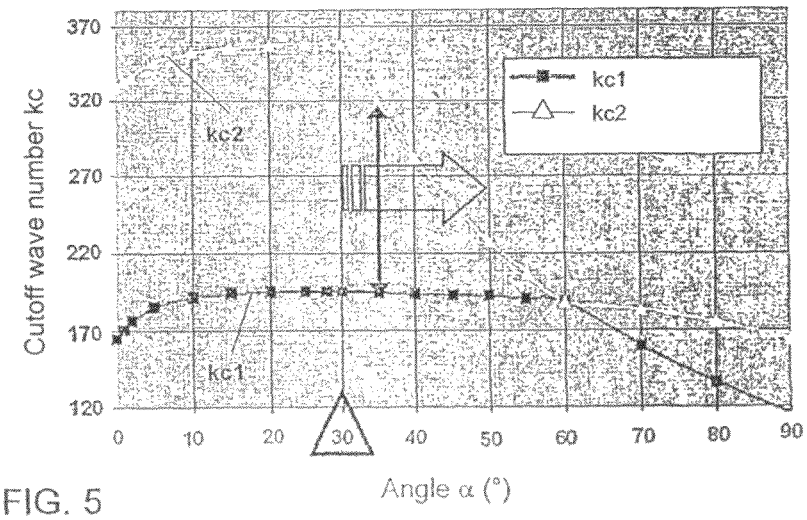
FIG. 5, variation in the cut-off wave number for two lowest order modes of a filter of the invention as a function of the angle formed by its two opposite sides that are not parallel.

The effect whereby the frequencies of the modes of the filter are shifted can be understood with the help of FIG. 5 which shows how the cut-off wave numbers kc1 and kc2 of the two lowest order modes (i.e. having the smallest wave numbers kc) vary with increasing angle α. It can be seen that the distance D between the modes remains practically constant for angles α lying in the range 0° (rectangular section filter) to 30°, and then drops off rapidly beyond 30°. Given that the effect of eliminating self-sustained electron-avalanche discharges is increased with increasing angle α, it can be understood why it is advantageous to select a value close to 30° so as to achieve the greatest threshold power while conserving good filter properties.

Figure 4:
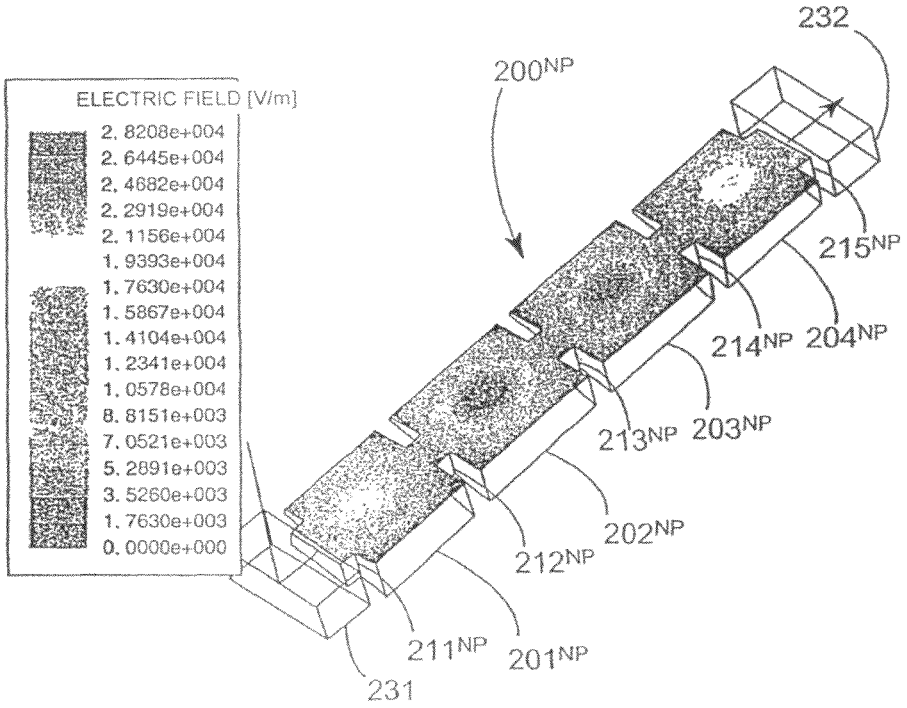
FIG. 4, the amplitude distribution of the electric field in the band center for a filter of the invention as shown in FIG. 2B.

FIG. 4 shows the distribution of the electric field amplitude within the filter $\mathbf{200}^{NP}$ of the invention for a standardized injected power of 1 W at 9.5 GHz. It can be seen that the amplitude peak of the field is located in the central resonance cavities $\mathbf{202}^{NP}$ and $\mathbf{203}^{NP}$. These cavities are therefore the only portions of the filter in which there is a significant risk of a self-sustained electron discharge appearing. Consequently, it is possible to limit the application of the principle of a waveguide having non-parallel walls to the central cavities only, while maintaining a rectangular section for the outer cavities and for the irises. However, it is preferred to use a structure with non-parallel walls for the entire length of the device in order to simplify fabrication thereof.

The method of adjusting dimensions is described above with reference to the particular circumstance of an inductive filter having resonant cavities and irises, however it can easily be generalized to other families of filters, e.g. to capacitive lowpass filters. Under all circumstances, it is necessary to calculate, generally with the help of numerical simulations, the waveguide cut-off frequency and the S parameters of each cavity or discontinuity. Thereafter, the various dimensions of the structure are modified as in the example.

The filter $\mathbf{200}^{NP}$ with non-parallel walls shown in FIG. 2B and the corresponding reference filter 200 shown in FIG. 2A have been made and their threshold powers at which self-sustained electron-avalanche discharge appears have been measured at band center (9.5 GHz). It has been found that said threshold power goes from 690 W for the conventional filter 200 to 850 W for the filter $\mathbf{200}^{NP}$ of the invention. The use of a geometry in accordance with the invention thus makes it possible to increase the maximum power that can be transmitted by a microwave filter by about 23%, i.e. nearly 1 dB. An even higher threshold power could be obtained by optimizing the shape of the waveguide, in particular the value of the angle α.

What is claimed is:

1. A microwave waveguide filter presenting at least one cut-off frequency in one of the following bands: X, Ku, K, and Ka and comprising a plurality of cascaded waveguide segments, each comprising a plurality of side walls, wherein at least one of said plurality of cascaded waveguide segments has a cross-section comprising a plurality of sides formed by sections of said plurality of side walls and a single hollow internal region of outline defined by said plurality of sides, wherein two opposite ones of said plurality of sides are not mutually parallel to avoid running a risk of inducing a self-sustained electron-avalanche discharge.

2. The microwave waveguide filter according to claim 1, in which said two opposite ones of said sides that are not mutually parallel are long sides.

3. The microwave waveguide filter according to claim 1, in which said hollow internal region presents a cross-section in the form of a triangle, a trapezoid, or a circular sector, or a circular annulus.

4. The microwave waveguide filter according to claim 1, in which said two non-parallel opposite sides are interconnected by two opposite sides of said plurality of sides that are mutually parallel.

5. The microwave waveguide filter according to claim 1, in which said cross-section presents an axis of symmetry.

6. The microwave waveguide filter according to claim 1, in which each of said plurality of cascaded waveguide segments has said cross-section which is constant over a certain length of the corresponding waveguide segment.

7. The microwave waveguide filter according to claim 1, in which said two non-parallel opposite sides form between them an angle lying in a range of 5° to 35°.

8. The microwave waveguide filter according to claim 1, in which said at least one of said plurality of cascaded waveguide segments having said cross-section which presents said two opposite sides that are not mutually parallel comprises at least one of the plurality of cascaded waveguide segments within which a maximum intensity of an electrical field is greatest.

9. The microwave waveguide filter according to claim 1, is of a type having irises and resonant cavities formed by said plurality of cascaded waveguide segments.

10. A microwave transmitter including at least one microwave waveguide filter according to claim 1.

11. The transmitter according to claim 10, presenting a peak power of at least 0.5 kW in the X to Ka bands.

12. The microwave waveguide filter according to claim 1, in which said two non-parallel opposite sides form between them an angle lying in a range of 15° to 35°.

13. The microwave waveguide filter according to claim 1, in which said two non-parallel opposite sides form between them an angle lying in a range of 20° to 30°.

* * * * *